US007231777B1

(12) United States Patent
Arnold et al.

(10) Patent No.: US 7,231,777 B1
(45) Date of Patent: Jun. 19, 2007

(54) PORTABLE PERSONAL COOLING DEVICE

(76) Inventors: Henry Arnold, 6414 S. Arlington Ave., Los Angeles, CA (US) 90043; Virginia Arnold, 6414 S. Arlington Ave., Los Angeles, CA (US) 90043

( * ) Notice: Subject to any disclaimer, the term of this patent is extended or adjusted under 35 U.S.C. 154(b) by 284 days.

(21) Appl. No.: 10/972,907

(22) Filed: Oct. 26, 2004

(51) Int. Cl.
*F25D 23/12* (2006.01)
*F25B 21/00* (2006.01)

(52) U.S. Cl. ..... 62/259.3; 62/457.9

(58) Field of Classification Search ..... 62/457.1, 62/457.9, 3.5, 371, 350, 259.3
See application file for complete search history.

(56) References Cited

U.S. PATENT DOCUMENTS 4,687,414 A * 8/1987 Wardy ..... 416/63
5,046,329 A * 9/1991 Travis, III ..... 62/259.3
5,217,408 A 6/1993 Kaine
5,386,823 A * 2/1995 Chen ..... 128/204.15
6,023,932 A * 2/2000 Johnston ..... 62/3.5
6,170,282 B1 1/2001 Eddins
6,543,247 B2 4/2003 Strauss
7,010,931 B2 * 3/2006 Lee ..... 62/259.3

* cited by examiner

*Primary Examiner*—Cheryl Tyler
*Assistant Examiner*—Michael J. Early
(74) *Attorney, Agent, or Firm*—Crossley Patent Law; Mark A. Crossley

(57) ABSTRACT

A portable personal cooling device substantially utilizing components typical in gas refrigerant air conditioning. The device is worn as a backpack, with adjustable shoulder straps for user size variations. Gas refrigeration provides effective cooling even in conditions of high humidity and temperature extremes. The device is compact, lightweight, and includes on/off and temperature control. Cooling is powered by a rechargeable battery or standard AC voltage, along with a transformer. The compressor is powered by the fan motor. A base for removably fitting the housing's base insert provides for upright storage and use of the device when not being worn.

10 Claims, 3 Drawing Sheets

PORTABLE PERSONAL COOLING DEVICE

BACKGROUND OF THE INVENTION

1. Field of the Invention

The invention relates to cooling devices but more specifically to a portable personal cooling device.

2. Description of the Prior Art

Prior art teaches various forms of cooling devices for use by individuals. The devices typically use air movement or air movement combined with evaporative cooling. In this respect and others, they differ from the present invention and its use of a compressed refrigerant for cooling air. By way of example:

U.S. Pat. No. 5,217,408 issued to Kaine on Jun. 8, 1993 discloses a personal portable cooling device that forces air against a person's back. The device relies upon perspiration to aid in cooling an individual.

U.S. Pat. No. 6,170,282 B1 issued to Eddins on Jan. 9, 2001 discloses a box which uses ice and forced air to cool an individual.

U.S. Pat. No. 6,543,247 B2 issued to Strauss on Apr. 8, 2003 discloses an evaporative personal cooler.

While the above-described devices fulfill their respective and particular objects and requirements, they do not describe a portable personal cooling device that provides for the advantages of the present invention; therefore, a need exists for an improved portable personal cooling device, particularly one that includes the use of a compressed refrigerant for cooling air. In this respect, the present invention substantially departs from the conventional concepts and designs of the prior art.

SUMMARY OF THE INVENTION

In view of the foregoing disadvantages inherent in the known types of personal cooling devices now present in the prior art, the portable personal cooling device overcomes the above-mentioned disadvantages and drawbacks or the prior art. As such, the general purpose of the portable personal cooling device, described subsequently in greater detail, is to provide a portable personal cooling device which has all of the advantages of the prior art mentioned heretofore and many novel features that result in an improved portable personal cooling device which is not anticipated, rendered obvious, suggested, or even implied by the prior art, either alone or in combination thereof.

To accomplish this, the portable personal cooling device comprises a substantially parallelepiped housing that is removably worn on a user's back. The housing is equipped with typical backpack type, adjustable, buckled straps so that it is adjusted to various sizes of users. The rear of the housing is substantially comprised of an access panel for removably covering the typical air conditioner components within the housing. Components are typical in the art of compressed refrigerant air conditioning. Atypical in the art is the fact that the fan motor also powers the compressor used to compress the refrigerant and move it through the system. The components further comprise an inlet vent in the rear of the housing for allowing the entrance of air to be cooled. Embodiments vary somewhat in fan choices. One embodiment uses a propeller type fan. Another embodiment utilizes an axial fan. A third embodiment utilizes a turbine fan. The internal fan shroud channels the incoming air across a typical air conditioning condenser. Air is then forced out of the outlet vent and to a user's back. The housing, on the housing front side that contacts the user's back, has pads that distance the housing outlet vent away from a user's back. Pads are generally peripherally disposed and provide comfort and greater air flow to the user.

A transformer is utilized to convert standard household voltage to that appropriate for operating the air conditioning components. A rechargeable battery is also included within the housing for operating the air conditioning components when household voltage is not available to the portable device. The portable personal cooling device provides a handle on the top of the housing for ease of transport when the invention is not being worn by a user. Additionally, the bottom of the housing is shaped with a base insert. The base insert removably fits within a base so that the invention is supported in a stationary upright position when not worn by a user. When stationary, the portable personal cooling device can be used as a stationary air conditioner, powered either by the rechargeable battery or standard AC outlet voltage.

An on/off switch and thermostat control provide additional advantages in operation of the portable personal cooling device. In the preferred embodiment, the housing is made substantially of plastic, with metal used on the internal components which typically require metal.

Yet another embodiment utilizes aluminum in the housing. The preferred size of the invention is about 12 inches high by 10 inches wide by 5 inches thick, thereby being lightweight and compact.

In yet a further embodiment, the internal components are powered by a small gasoline engine, rather than electricity.

By utilizing compressed refrigerant cooling technology, the invention is not limited with regard to humidity or extremely hot conditions but, instead, remains functional is such adverse environments.

Thus has been broadly outlined the more important features of the portable personal cooling device so that the detailed description thereof that follows may be better understood and in order that the present contribution to the art may be better appreciated.

Numerous objects, features and advantages of the portable personal cooling device will be readily apparent to those of ordinary skill in the art upon reading the following detailed description of presently preferred, but nonetheless illustrative, embodiments of the portable personal cooling device when taken in conjunction with the accompanying drawings. In this respect, before explaining the current embodiments of the portable personal cooling device in detail, it is to be understood that the invention is not limited in its application to the details of construction and arrangements of the components set forth in the following description or illustration. The invention is capable of other embodiments and of being practiced and carried out in various ways.

It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the portable personal cooling device. It is therefore important that the claims be regarded as including such equivalent constructions insofar as they do not depart from the spirit and scope of the present invention.

A primary object, then, of the portable personal cooling device is to utilize substantially typical compressed refrigerant air conditioning technology.

An added object of the portable personal cooling device is to provide for superior cooling without regard to humidity and high heat.

Yet another object of the portable personal cooling device is to provide a compact lightweight device.

And, it is an object of the portable personal cooling device to provide for use either on a user's back or from a stationary, supported position.

These together with additional objects of the portable personal cooling device, along with various novel features that characterize the invention are particularly pointed out in the claims forming a part of this disclosure. For better understanding of the portable personal cooling device, its operating advantages and specific objects attained by its uses, refer to the accompanying drawings and description.

DETAILED DESCRIPTION OF THE PREFERRED EMBODIMENT

Figure 1:
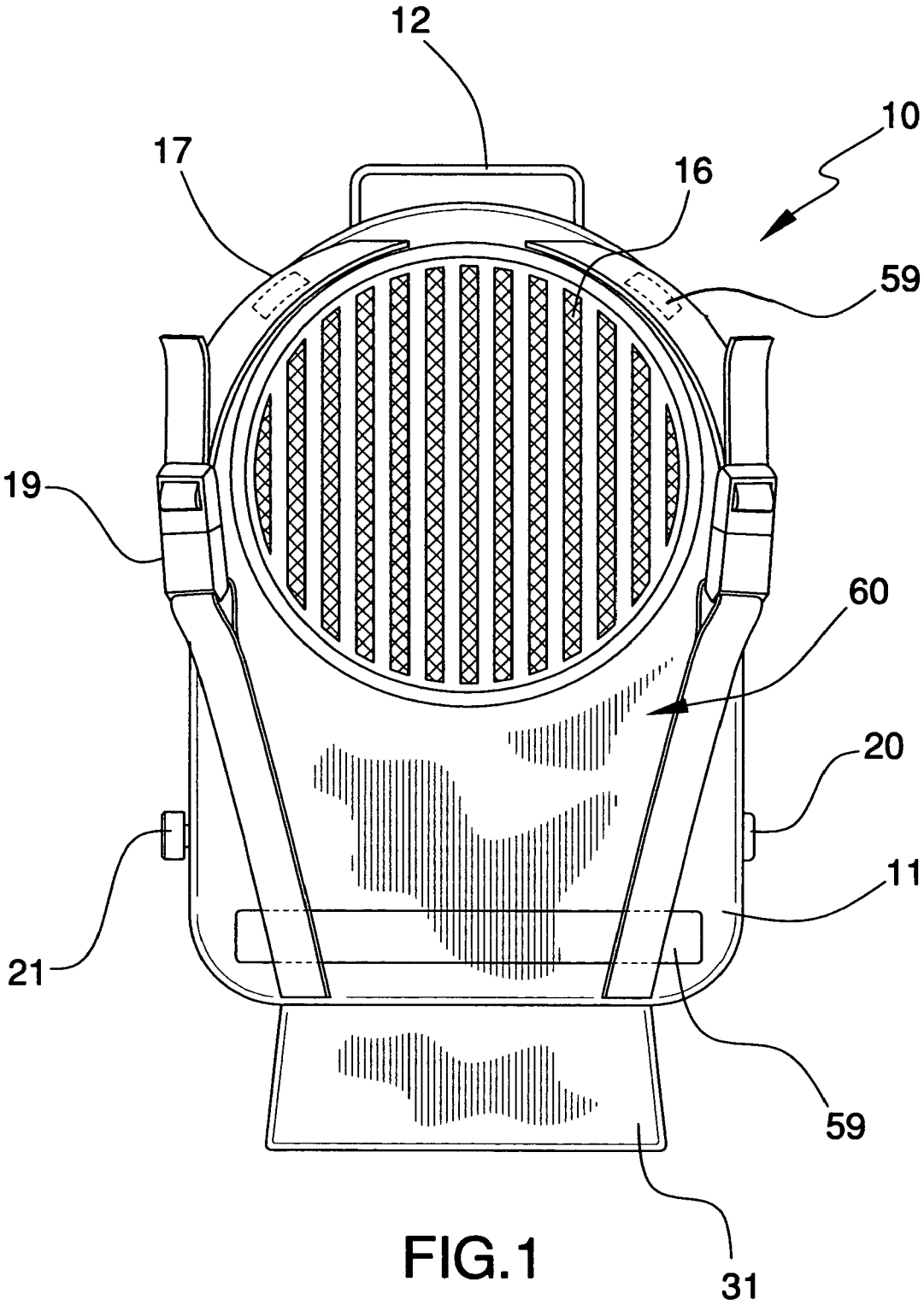
FIG. 1 is a frontal view of the portable personal cooling device.
Figure 2:
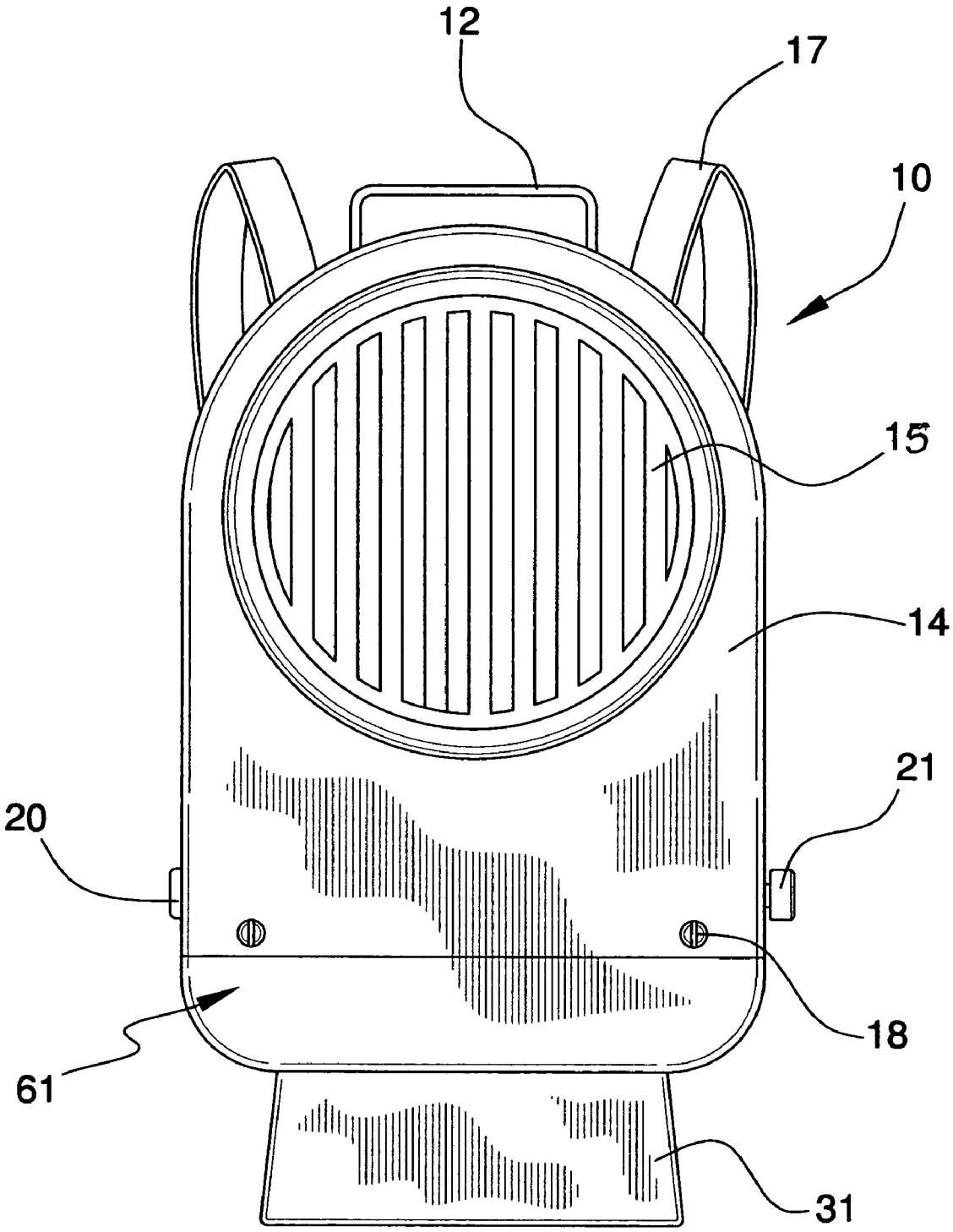
FIG. 2 is a rear view of the portable personal cooling device.
Figure 3:
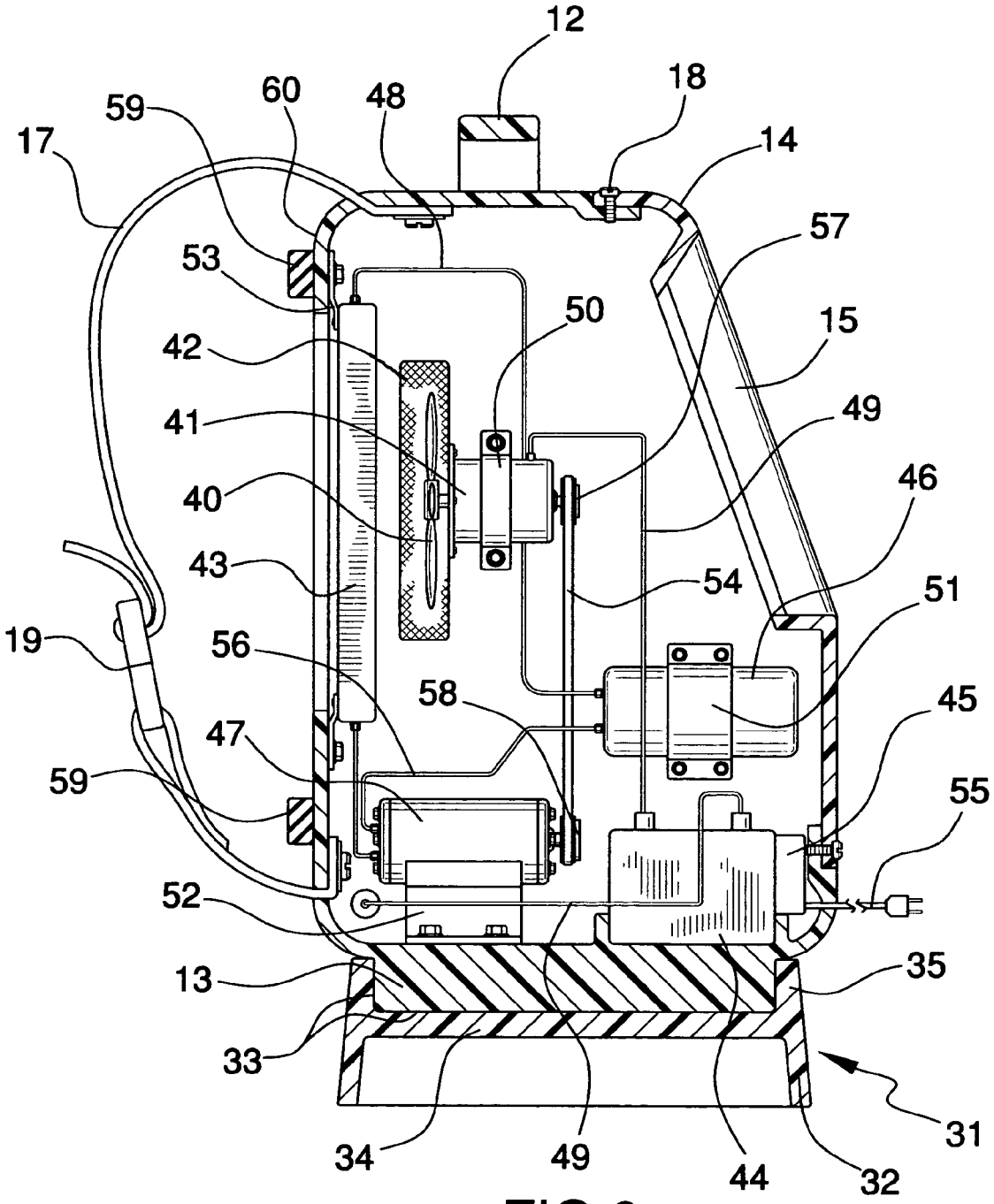
FIG. 3 is a lateral cross sectional view of the internal components of the portable personal cooling device.

With reference now to the drawings, and in particular FIGS. 1–3 thereof, the preferred embodiment of the portable personal cooling device employing the principles and concepts of the present invention and generally designated by the reference number 10 will be described.

Referring to FIG. 1, the portable personal cooling device 10 comprises a substantially parallelepiped exterior housing 11 with attached, adjustably removable shoulder straps 17. Straps originate and terminate in the front of the invention 10 and disposedly emanate from the top of housing front 60 and fasten within the bottom of the front 60. Adjustable buckles 19 are typical in the art of fastening hardware. Disposed upwardly within the front 60 of invention 10 is circular air outlet vent 16. Pads 59 are disposed peripherally on housing front 60, both downwardly and upwardly.

Housing back 61 (FIG. 2) is substantially comprised of access panel 14. Panel 14 is removably fastened to housing back 61 by typical fasteners 18. Circular air inlet vent 15 is disposed upwardly and centrally in access panel 14. Vent 15 is inwardly slanted from vertical (FIG. 3) to further reduce the overall dimensions of invention 10. On the left side of invention 10, disposed proximal to the lower extremity of housing 11, is on/off switch 20. Temperature control 21 is disposed on housing 11 on the side opposite switch 20 and communicates with battery 44 via electrical wire 49. Base insert 13 comprises substantially the entire bottom of housing 11. Top of housing 11 holds handle 12 for ease of transport of invention 10. Base insert 13 removably fits within base 31. Base 31 provides upright support for housing 11 when housing 11 is not on a user (not shown). Base 31 is comprised of legs 32 which continue vertically above horizontal platform 34. From thence, legs 32 continue into leg extensions 35. Leg extensions 35 and platform 34 thereby form receptacle 33 for removable receipt of base 31.

Air conditioning components typical in the art of compressed refrigerant air conditioning are utilized by invention 10. Components are comprised of fan motor 41 which turns fan 40. Fan mount 50 secures motor 41 within housing 11. Fan shroud 42 channels air from fan 40 toward outlet vent 16. Motor 41 also turns compressor 47, disposed within the lower region of housing 11. Motor 41 is fitted with a pulley 57, at an end of motor 41 opposite fan 40. Belt 54 provides rotational force to compressor 47 via motor pulley 57 and compressor pulley 58. Compressor 47 is securely mounted within housing 11 by compressor mount 52. Compressor 47 draws refrigerant (not shown) from refrigerant reservoir 46 via refrigerant supply line 56. Refrigerant is pushed through condensor 43 and returns to reservoir 46 via refrigerant return line 48. Condensor 43 is secured within housing 11 by condensor mount 53. Condensor 43 is just within air outlet vent 16 of housing front 60. Reservoir 46 is mountedly disposed within the lower area of housing 11 by refrigerant reservoir mount 51.

Rechargeable battery 44 is disposed downwardly from reservoir 46. Battery 44 powers fan motor 41 when exteriorly accessible on/off switch 20 is turned on. Battery 44 is connected to transformer 45. Transformer 45 is powered by electrical cord 55. Power to motor 41 is thereby provided by either battery 44 or electrical cord 55 powering transformer 45.

In use, invention 10 is removed from base 31 with the assistance of handle 12. Invention 10 is adjustably strapped on a user's back with shoulder straps 17 surrounding a user's shoulders. Straps 17 are snapped together and adjusted in length by buckles 19.

Pads 59 provide comfort to a user and also provide space between outlet vent 16 and a user's back (not shown) so that air flow to a user is further enabled. User uses on/off switch 20 to initiate cooling. Temperature control 21 further modulates cooling. User may leave invention 10 plugged into standard AC outlet via electrical cord 55, or user may elect to be mobile and remove cord 55. Invention 10 is thereby powered by rechargeable battery 44 for continued cooling of a user. Upon removal of shoulder straps 17 and hence invention 10, user returns invention 10 to base 31, inserting base insert 13 into base 31 for support. Invention 10 is electively continued in use by aiming air outlet vent 16 to the desired position. Invention 10 is operated on battery 44 or plugged in to standard outlet to operate via household current. Household current also recharges battery 44.

With respect to the above description then, it is to be realized that the optimum dimensional relationships for the parts of the portable personal cooling device, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A portable personal cooling device, comprising:

a substantially parallelepiped ventilated housing containing interconnected air conditioning components, the components typical of air conditioning components utilizing a gas refrigerant;

a fan motor with fan within the ventilated housing, the fan moving air into and out of the housing and toward a user;

a pair of adjustable, removable shoulder straps fastened to a front of the housing, the straps removably holding the invention to a back of a user;

powering means for the air conditioning components wherein the powering means comprise:

a rechargeable battery;

a transformer and an electrical cord for utilizing standard household electrical voltage, the household voltage comprising 20 volts AC, 60 Hertz, 0.35 amps and 17 watts;

a switch for controlling the powering means; and wherein the fan motor is further utilized to power a gas refrigerant compressor by way of a motor pulley, a compressor pulley and a belt connecting the pulleys.

2. The portable personal cooling device in claim 1 wherein the exterior of the housing is about 12 inches high by 10 inches wide by 5 inches thick.

3. The portable personal cooling device in claim 2 wherein the portable personal cooling device further comprises a downwardly disposed base insert at a bottom of the housing;

a base for removably receiving the base insert, the base comprising two legs laterally supporting a platform, the platform and upward leg extensions of the base providing upright support for the portable personal cooling device.

4. The portable personal cooling device in claim 3 wherein the housing further comprises an access panel disposed on a housing back, the access panel removably covering substantially all of the housing back.

5. The portable personal cooling device in claim 4 wherein the housing front further comprises pads, the pads disposed peripherally on an exterior of the housing front.

6. A portable personal cooling device, comprising:

a substantially parallelepiped ventilated housing containing interconnected air conditioning components within, the components substantially typical of air conditioning components utilizing a gas refrigerant, the components further comprising:

a fan motor with attached fan within the ventilated housing, the fan moving air into and out of the housing, the air entering through an air inlet in a housing back;

a fan shroud disposed within the housing and about the fan, the shroud further channeling air across a condensor, the condensor disposed just within an air outlet, the outlet disposed within a housing front of the housing;

the condensor supplied with a typical gas refrigerant, the refrigerant supplied by a compressor disposed within the housing, the compressor for receiving the gas refrigerant from a reservoir disposed within the housing, the compressor compressing and propelling the gas refrigerant through the condensor and back to the refrigerant reservoir;

a fan motor pulley attached to the fan motor at an opposite end of the fan attachment, a compressor pulley attached to the compressor, and a belt shared by the pulleys, whereby the fan motor further provides power via the belt and turns the compressor;

a rechargeable battery disposed within the housing, the battery powering the fan motor;

a switch for turning on the power from the battery to the fan motor.

7. The portable personal cooling device in claim 6 wherein the air conditioning components further comprise a temperature control disposed on the housing, the temperature control outwardly accessible and electrically communicating with the air conditioning components.

8. The portable personal cooling device in claim 7 wherein the air conditioning components further comprise a transformer electrically communicating with the battery, the transformer disposed within the housing, the transformer further comprising an electrical cord removably plugging into a standard AC outlet voltage, thereby providing standard electrical powering of the portable personal cooling device and for battery recharging.

9. The portable personal cooling device in claim 8 wherein the housing front further comprises pads, the pads disposed peripherally on an exterior of the housing front.

10. The portable personal cooling device in claim 9 wherein the portable personal cooling device further comprises a downwardly disposed base insert at a bottom of the housing;

a base removably receiving the base insert, the base comprising two legs laterally supporting a platform, the platform, and upward leg extensions of the base, thereby providing upright support for the portable personal cooling device.

* * * * *